US005834145A

United States Patent [19]

Yoshinaga et al.

[11] Patent Number: 5,834,145

[45] **Date of Patent: *Nov. 10, 1998**

[54] ELECTROPHOTOGRAPHIC PHOTOSENSITVE MEMBER AND IMAGE FORMING APPARATUS

[75] Inventors: Kazuo Yoshinaga, Kawasaki; Yuichi Hashimoto, Tokyo; Yoshio Kashizaki, Yokohama; Yasuko Hayashi, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 568,300

[22] Filed: Dec. 6, 1995

[30] Foreign Application Priority Data

Dec. 7, 1994 [JP] Japan ..... 6-303949

[51] Int. Cl.[6] ..... G03G 5/10; G03G 5/047; G03G 15/043

[52] U.S. Cl. ..... 430/31; 430/58; 430/69; 399/159

[58] Field of Search ..... 430/58, 69, 31; 355/211; 399/159

[56] References Cited

U.S. PATENT DOCUMENTS

| | | | |
|---|---|---|---|
| 4,618,522 | 10/1986 | Tanaka et al. | 430/60 |
| 4,675,262 | 6/1987 | Tanaka | 430/58 |

FOREIGN PATENT DOCUMENTS

| | | | |
|---|---|---|---|
| 58-082249 | 5/1983 | Japan . | |
| 60-086550 | 5/1985 | Japan . | |
| 60-184258 | 9/1985 | Japan . | |
| 60-186850 | 9/1985 | Japan | G03G 5/14 |
| 60-247647 | 12/1985 | Japan | G03G 5/14 |
| 61-18963 | 1/1986 | Japan . | |
| 63-113459 | 5/1988 | Japan . | |
| 1-129260 | 5/1989 | Japan . | |
| 1-169454 | 7/1989 | Japan . | |
| 1-172863 | 7/1989 | Japan . | |
| 2186988 | 8/1987 | United Kingdom | G03G 5/05 |

OTHER PUBLICATIONS

Borsenberger, Paul M. & David S. Weiss. Organic Photoreceptors for Imaging Systems. New York: Marcel–Dekker, Inc. pp. 6–17, 1993.

*Primary Examiner*—Christopher D. Rodee
*Attorney, Agent, or Firm*—Fitzpatrick, Cella, Harper & Scinto

[57] ABSTRACT

An electrophotographic photosensitive member is constituted by disposing a photosensitive layer including a charge generation layer and a charge transport layer on an electroconductive support. The charge transport layer has a thickness of at most 12 $\mu$m and is formed by dispersing therein particles having a particle size of 1–3 $\mu$m at a density of $1\times10^4$–$2\times10^5$ particles/mm$^2$. The charge transport layer and the particles described above provides a difference in refractive index of at least 0.10.

The photosensitive member is effective in providing good images free from black spots and interference fringes and with a good gradation-reproducing characteristic when used as a structural member of a process cartridge and an image forming apparatus.

10 Claims, 4 Drawing Sheets

ELECTROPHOTOGRAPHIC PHOTOSENSITVE MEMBER AND IMAGE FORMING APPARATUS

FIELD OF THE INVENTION AND RELATED ART

The present invention relates to an electrophotographic photosensitive member having a specific charge transport layer, a process cartridge using the photosensitive member, and an image forming apparatus using the photosensitive member.

Among known image forming apparatus, there are laser beam printers using electrophotography, which are known as high-speed and low-noise printers. A representative recording method thereof includes binary recording of forming images, such as characters and figures, depending on whether or not a particular portion of photosensitive member is irradiated with a laser beam. Further, a certain type of printer based on such a binary recording scheme can exhibit halftones.

Well-known examples of such printers may include those utilizing the dither method and the density pattern method. However, as is well known, it is difficult for such a printer based on the dither method or the density pattern method to provide a high resolution.

On the other hand, in recent years, the PWM (pulse width modulation) scheme has been proposed as a scheme for forming a halftone at each pixel while retaining a high resolution and without lowering the recording density. According to this scheme, the laser beam irradiation time is modulated based on image signals to form halftone pixels. According to the PWM scheme, an areal gradation image can be formed with a dot formed by a beam spot for each pixel, so that a halftone can be exhibited without lowering the resolution. Accordingly, this scheme is particularly suitable for a color image forming apparatus requiring a high resolution and a high gradation characteristic in combination.

Even in the PWM scheme, however, if the pixel density (or picture element density) is further increased, the pixel size is decreased relative to the exposure spot diameter, so that it is liable to be difficult to realize sufficient gradation levels even if the exposure time is modulated. For this reason, in order to provide a higher resolution while retaining the gradation characteristic, it is necessary to provide a smaller exposure spot diameter. In order to accomplish this in a scanning optical system, for example, it becomes necessary to use a laser beam having a shorter wavelength or an f-θ lens having a larger NA (numerical aperture). According to these measures, however, it becomes necessary to use expensive laser and large-sized lens and scanner and also requires an increased mechanical accuracy corresponding to a lowering in focal depth, thus inevitably resulting in an increase in apparatus size and an increase in production cost. Further, even in case of using a solid state scanner, such as an LED array or a liquid crystal shutter array, it is difficult to avoid an increase in cost of the scanner, a required increase in affixing accuracy and an increase in cost of an electrical drive circuit.

In spite of existing problems as described above, an image forming apparatus according to the electrophotographic scheme has been required to exhibit even an higher resolution and gradation characteristic in recent years.

In these circumstances, there have been proposed various methods for improving a resolution and gradation characteristic by using a toner having a smaller particle size at the time of development or providing uniform development conditions. However, these methods have failed to provide a sufficient reproducibility of gradation data, such as full-color image data with 256 gradation levels and 400–600 lines which can be discerned by visual (eye) observation and also to sufficiently reproduce a binary image, such as characters, with a high resolution.

On the other hand, there has been proposed a method using an electrophotographic photosensitive member having a characteristic such that it shows a low sensitivity at a low exposure energy and a higher sensitivity at an increasing exposure energy in, e.g., Japanese Laid-Open Patent Application (JP-A) 1-169454 or 1-172863. According to this method, such a photosensitive member provides a low sensitivity at the low exposure energy portion of an illumination spot, so that it has become possible to attain an effect similar to that of the smaller illumination spot diameter and also to stably obtain a high resolution which is higher than a resolution expected by the illumination spot diameter. However, even if the photosensitive member is used, it has been difficult to stably reproduce gradation images of 400 lines by using the PWM scheme.

As described above, a discernible image by the naked eye generally includes 400 lines and 256 gradation levels. In this instance, the minimum resolution is of the order of 16 $\mu m^2$ corresponding to a resolution of at least 5000 dpi (dots/inch). In order to realize such a high resolution, it is necessary to provide at least a smaller spot area of light. However, in the case of only minimizing a spot area, high quality images as described above have not been formed.

Further, in order to obtain a small spot area essential to a digital image formation scheme providing a high resolution, a strong coherent light may preferably be used. In case of using such a strong coherent light, a phenomenon of an occurrence of so-called interference fringes such that a fringe pattern occurs in an output image to considerably lower an image quality has occurred. This phenomenon is caused by interference of reflected light at boundary surfaces between respective layers constituting a photosensitive member. Further, this is presumably because a difference in degree of interference resulting from layer thickness irregularity (uneven layer thickness) caused at the time of producing the photosensitive member leads to an inferior image.

In order to prevent or minimize the above interference, there has been proposed various methods including: one providing a surface to be covered with a photosensitive layer with unevenness (JP-A 60-186850); one disposing a light-absorbing layer under a photosensitive layer (JP-A 60-184258); one providing a lower part of a photosensitive layer with unevenness (JP-A 60-247647); one wherein almost light is absorbed by a photosensitive layer (JP-A 58-82249); one wherein a light-absorbing substance or light-scattering substance is mixed in a photosensitive layer (JP-A 60-86550); and one wherein organic polymer fine particles are mixed in a photosensitive layer (JP-A 63-113459).

According to the above methods, however, resultant photosensitive members have not been sufficient to provide a high-quality image with a high resolution and free from interference fringes.

SUMMARY OF THE INVENTION

An object of the present invention is to provide an electrophotographic photosensitive member capable of providing an image having a high resolution and an excellent gradation characteristic while suppressing an occurrence of interference fringes on the resultant image.

Another object of the present invention is to provide a process cartridge and an image forming apparatus each including the above electrophotographic photosensitive member.

According to the present invention, there is provided an electrophotographic photosensitive member, comprising: an electroconductive support and a photosensitive layer, disposed on the electrophotographic support, comprising a charge generation layer and a charge transport layer, wherein the charge transport layer has a thickness of at most 12 $\mu$m and contains particles having a particle size of 1–3 $\mu$m at a density of $1\times10^4$–$2\times10^5$ particles/mm$^2$, and the charge transport layer has a first refractive index and the particles have a second refractive index, the first and second refractive indices providing a difference therebetween of at least 0.10.

According to the present invention, there is also provided a process cartridge, comprising: an electrophotographic photosensitive member including an electroconductive support and a photosensitive layer disposed on the electroconductive support comprising a charge generation layer and a charge transport layer; and at least one means selected from the group consisting of charging means, developing means, and cleaning means; wherein the photosensitive member and the above-mentioned at least one means selected from the group consisting of charging means, developing means, and cleaning means are integrally supported to form a cartridge which is detachably mountable to an image forming apparatus main body, and the charge transport layer has a thickness of at most 12 $\mu$m and contains particles having a particle size of 1–3 $\mu$m at a density of $1\times10^4$–$2\times10^5$ particles/mm$^2$, and the charge transport layer has a first refractive index and said particles have a second refractive index, the first and second refractive indices providing a difference therebetween of at least 0.10.

According to the present invention, there is further provided an image forming apparatus, comprising: an electrophotographic photosensitive member including an electroconductive support and a photosensitive layer disposed on the electroconductive support comprising a charge generation layer and a charge transport layer, charging means for charging the photosensitive member, exposure means for illuminating the charged photosensitive member with light, developing means, and transfer means; wherein the charge transport layer has a thickness of at most 12 $\mu$m and contains particles having a particle size of 1–3 $\mu$m at a density of $1\times10^4$–$2\times10^5$ particles/mm$^2$, and the charge transport layer has a first refractive index and the particles have a second refractive index, the first and second refractive indices providing a difference therebetween of at least 0.10.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
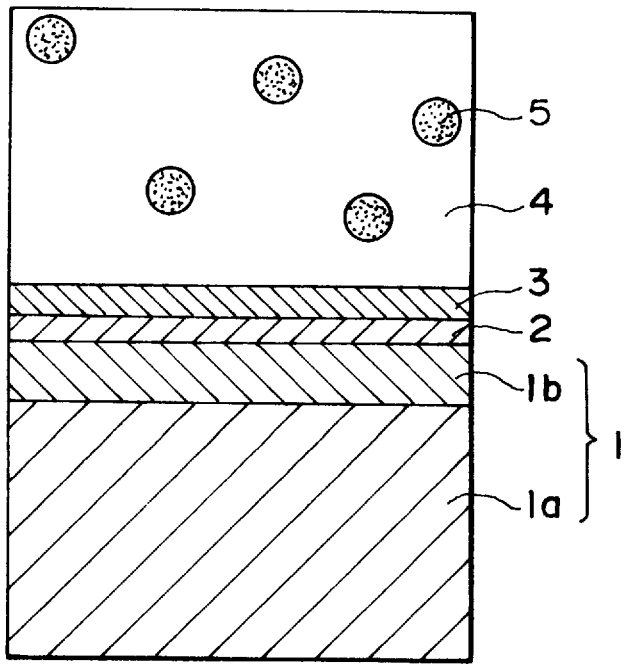
FIG. 1 is a schematic sectional view of an embodiment of the electrophotographic photosensitive member according to the present invention.

The electrophotographic photosensitive member according to the present invention is principally constituted by disposing a photosensitive layer including a charge generation layer and a charge transport layer on an electroconductive support. The charge transport layer has a thickness of 12 $\mu$m or below and contains particles having a particle size of 1–3 $\mu$m at a density of $1\times10^4$–$2\times10^5$ particles/mm$^2$. The particles have a refractive index different from that of the charge transport layer by at least 0.10.

Based on the above characteristic features, the electrophotographic photosensitive member of the present invention can provide excellent images having a high resolution and a good gradation reproducibility.

This may be attributable to the following phenomenon.

More specifically, in a photosensitive layer used in the present invention, it has been found that image data given by a light spot is not readily deteriorated because diffusion of a (charge) carrier for forming an electrostatic latent image can be suppressed. In addition, based on improvement in potential contrast caused by the thus formed electrostatic latent image within the photosensitive layer, it has been confirmed that a potential contrast within a space between a photosensitive member and a developing sleeve can be enhanced. As a result, the given image data is not readily deteriorated to provide a high quality image.

Further, in order to prevent an occurrence of interference fringes etc., light-scattering particles have been heretofore contained in a photosensitive layer. In such a case, however, resultant images per se have been deteriorated in some cases due to a high residual potential or an excessive degree of light scattering although interference fringes have been prevented effectively.

In the present invention, interference fringes are more effectively suppressed without adversely affecting resultant images per se because a thinner charge transport layer having a thickness of at most 12 $\mu$m is used to shorten a light path and the number of particles to be contained in the charge transport layer is reduced.

In the present invention, the photosensitive layer may have a function-separation type structure wherein a charge generation layer comprising a charge-generation substance and a charge transport layer comprising a charge-transporting substance are disposed in this order or in reverse order. In the present invention, the photosensitive layer may preferably have a function-separation type structure including the charge generation layer and the charge transport layer disposed in this order on an electroconductive support (described hereinafter).

Examples of the charge generation substance may include: selenium-tellurium, pyryllium dyes, thiopyryllium dyes, phthalocyanine pigments, anthoanthrone pigments, dibenzpyrenequinone pigments, pyranthrone pigments, trisazo pigments, disazo pigments, azo pigments, indigo pigments, quinacridone pigments and cyanine pigments.

Examples of the charge transporting substance may include: polymeric compounds having a heterocyclic ring or a condensed polycyclic aromatic structure, such as poly-N-vinylcarbazole and polystyrylanthracene; heterocyclic compounds, such as pyrazoline, imidazole, oxazole, oxadiazole, triazole and carbazole; triarylalkane derivatives, such as triphenylmethane; triarylamine derivatives, such as triphenylamine; and low-molecular weight compounds, such as phenylenediamine derivatives, N-phenylcarbazole derivatives, stilbene derivatives and hydrazone derivatives.

The above-mentioned charge-generation substance and charge-transporting substance may be dispersed or dissolved, as desired, in a binder polymer. Examples of the binder polymer may include; polymers or copolymers of vinyl compounds, such as styrene, vinyl acetate, vinyl chloride, acrylates, methacrylates, vinylidene fluoride and trifluoroethylene, polyvinyl alcohol, polyvinyl acetal, polycarbonate, polyester, polysulfone, polyphenylene oxide, polyurethane, cellulosic resin, phenolic resin, melamine resin, silicone resin and epoxy resin.

The charge generation layer may preferably have a thickness of at most 3 $\mu$m, particularly 0.01–1 $\mu$m. The charge transport layer has a thickness of at most 12 $\mu$m, and may preferably have a thickness of at most 10 $\mu$m.

In view of a possibility of an occurrence of a pinhole or lowering in photosensitivity, the photosensitive layer may preferably have a thickness (as a total thickness of the charge generation layer and the charge transport layer) of at least 1 $\mu$m, particularly at least 3 $\mu$m. The thickness of the photosensitive layer (the charge generation layer and/or charge transport layer) may be measured by using an eddy current-type thickness measuring apparatus.

In the present invention, the photosensitive layer may preferably be illuminated with an exposure light beam providing a spot area (S) and may preferably have a thickness (T) providing the product (S×T) of at most $2\times10^4$ $\mu m^3$.

Further, the product (S×T) may preferably be at least $2\times10^3$ $\mu m^3$ in view of a development contrast (i.e., a potential difference on a photosensitive member at the time of development). If a value of S×T is below $2\times10^3$ $\mu m^3$, it is liable to be difficult to provide a sufficient development contrast.

In this instance, an exposure means adopted in the present invention is used for forming an electrostatic latent image on the photosensitive member by illuminating the surface of the photosensitive layer with an exposure light beam issued from the exposure means, thus providing the photosensitive member surface with a dot-like spot. In this instance, the exposure means may preferably be a light source emitting a coherent light (beam), such as a laser light (laser beam) or LED light beam (light beam issued from LED) each having high coherency in order to readily provide the dot-like spot with a smaller spot area.

Figure 2:
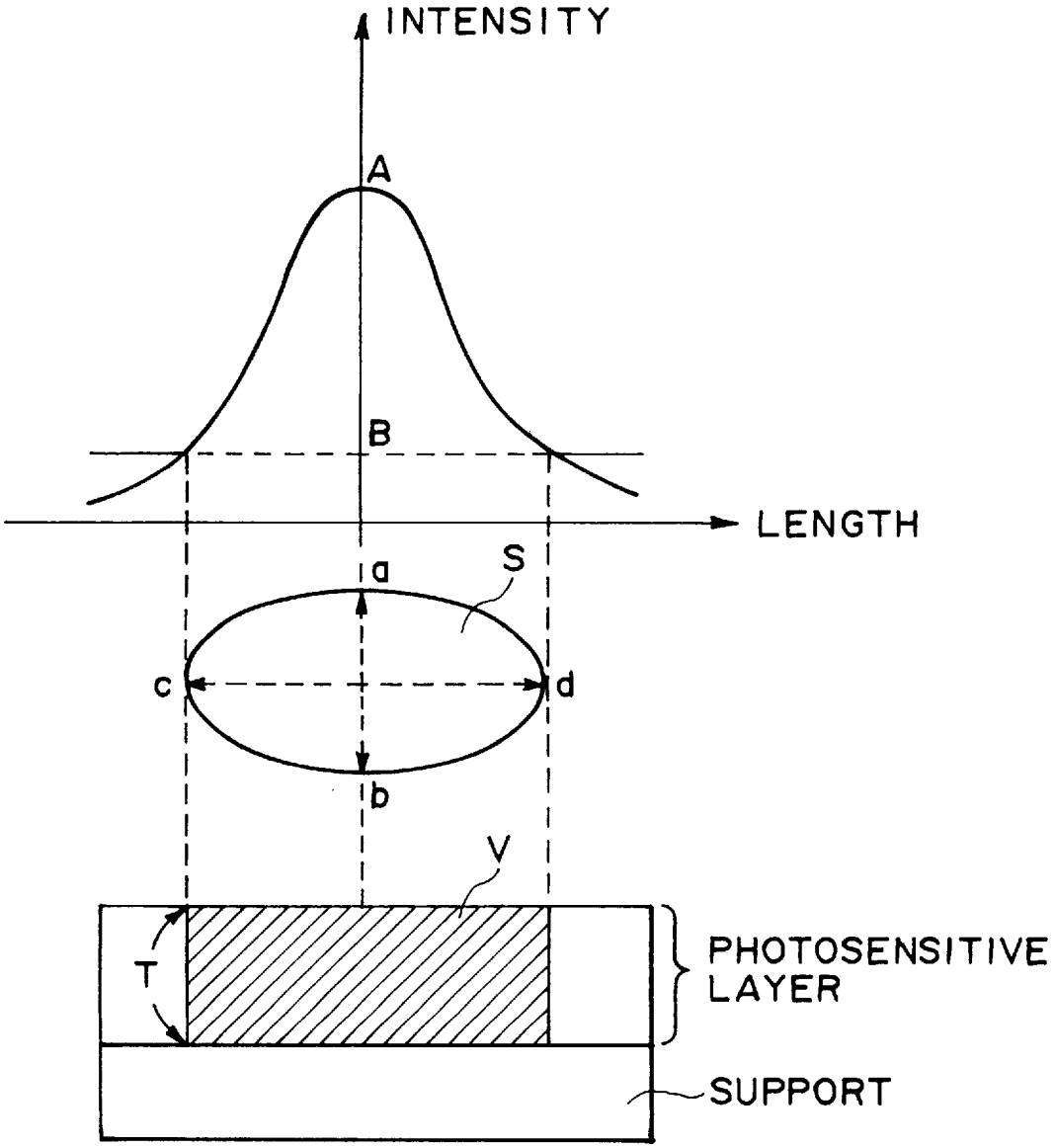
FIG. 2 is a set of views showing a relationship between a light intensity distribution and a spot diameter and a relationship between a spot area (S) of light and a thickness (T) of a photosensitive layer.

FIG. 2 shows a relationship between a light intensity distribution and a spot diameter. FIG. 2 also shows a relationship between a spot area (S) of light and a thickness (T) of a photosensitive layer formed on an electroconductive support. Referring to FIG. 2, the light spot generally has a shape of an ellipse having a spot diameter (ab) in a main (or horizontally) scanning direction and a spot diameter (cd) in a sub-scanning (or vertically scanning) direction. The product S×T corresponds to a volume (V) of the light spot. The light spot area (S) is an area at the surface of the photosensitive layer wherein a light intensity (B) which is $1/e^2$ of the peak intensity (A) or a light intensity in the range of above B to A is provided.

In the present invention, examples of a light source (as exposure means) for providing the light spot may include a semiconductor laser or an LED issuing an exposure light.

The light intensity distribution may be based on Gaussian distribution or Lorentz distribution. In either case, the spot area (S) referred to in the present invention provides a light intensity distribution as shown in FIG. 2 wherein a light intensity ranges from B to A (B is $1/e^2$ of A). The spot area (S) can be determined based on observation through a CCD camera disposed in the position of a photosensitive member.

In the present invention, the spot area (S) of light may preferably be at most $4\times10^3$ $\mu m^2$, more preferably at most $3\times10^3$ $\mu m^2$. If the spot area (S) exceeds $4\times10^3$ $\mu m^2$, the light spot having the spot area is liable to overlap with adjacent light spots, thus resulting in an unstable gradation reproducibility. Further, in view of production cost, the spot area (S) may preferably be at least 1,000 $\mu m^2$.

From the above point of view, the photosensitive layer of the photosensitive member of the present invention may preferably have a thickness (T) of at most 10 $\mu$m, particularly at most 8 $\mu$m.

In the present invention, the charge transport layer contains particles having the following properties (a)–(c):

(a) a difference in refractive index with that of the charge transport layer of at least 0.10 (as an absolute value), (b) a particle size of 1–3 $\mu$m, and (c) a dispersion density of $1\times10^4$–$2\times10^5$ particles per 1 $mm^2$.

With respect to the above property (a), the resultant index of the charge transport layer may be measured by using Abbe's refractometer. In this case, a sample film may be prepared in the same manner as in the charge transport layer in Examples appearing hereinafter except that particles to be contained in the charge transport layer are not used.

On the other hand, the refractive index of particles may be measured according to (oil) immersion method. In this instance, D-line (Na) having a wavelength of about 589 nm is used.

The (refractive index) difference between a refractive index of the particles and a refractive index of the charge transport layer may preferably be in the range of 0.10 to 1.00. If the refractive index difference (as an absolute value) is below 0.10, it is difficult to provide a coherent light (e.g., laser beam) with a sufficient phase difference (phase angle), thus failing to attain a sufficient interference fringe-preventing effect. If the refractive index difference exceeds 1.00, the particles are liable to be readily sedimented (or deposited) in a coating liquid for the charge transport layer because such particles generally have a large specific gravity.

With respect to the above-mentioned property (b), the particle size of the above particles is a number-average particle size of a primary particle measured by using a measurement apparatus, such as a scanning electron microscope. For simple measurement, a Coulter counter or an apparatus according to a laser diffraction method may also be used.

If the particles have a particle size of below 1 $\mu$m, a coherent light used is liable to have a small phase difference and a diffraction angle generated by the particles is liable to become large, so that resultant images are deteriorated in some cases. If the particle size exceeds 3 $\mu$m, a volume fraction of the particles in the photosensitive layer is increased to adversely affect electrical properties, such as electroconductivity.

The particles used in the charge transport layer may preferably have a small particle size distribution. More specifically, the particles may preferably have a particle size distribution wherein an average value ($\pm\sigma$) of standard deviation ($\sigma$) is in the range of 1–3 $\mu$m.

With respect to the above-mentioned property (c), the dispersion density of the particles may be measured by observing the number of the particles in a prescribed region of a resultant photosensitive member with a reflection-type optical microscope. More specifically, the number of particles present in a region having an area of at least 10 $\mu$m×10 $\mu$m is observed through the optical microscope with respect to ten different regions. An average number of particles present in an average area of the regions is converted into the number of particles per an area of 1 $mm^2$ to determine a (dispersion) density of the particles within the charge transport layer.

If the particles have a density of below $1\times10^4$ particles/$mm^2$, the interference fringe-preventing effect becomes insufficient. If the particles have a density of above $2\times10^5$ particles/$mm^2$, such particles cause excessive light scattering and a lowering in electric properties, such as electroconductivity.

Examples of the particles to be contained in the charge transport layer may include organic resin particles and inorganic particles. The particles may preferably be transparent and homogeneous and may also preferably have a uniform particle size. Specific examples of such particles may include particles of substances, such as silicone resin, $SiO_2$, $Al_2O_3$, phenolic resin, $TiO_2$, ZnO, tetrafluoroethylene resin, polydivinylbenzene-type resin and benzoguanamine resin (e.g., a condensation product of benzoguanamine and formaldehyde). These substances may preferably be an insulating material in view of a withstand voltage of a resultant photosensitive member. More specifically, the particles may preferably have a volume resistivity of at least $1\times10^9$ ohm.cm.

In addition to the above-mentioned compounds, the photosensitive layer can contain some additives for improving the mechanical properties or durability or other purposes. Examples of such additives may include; antioxidant, ultraviolet absorber, crosslinking agent, lubricant and electroconductivity controller.

In the present invention, the photosensitive layer (particularly the charge transport layer) may preferably have a smaller thickness (e.g., 1–10 $\mu$m) as described above, so that a protective layer may preferably be disposed on the photosensitive layer. The protective layer may preferably have a thickness of 1–5 $\mu$m. Below 1 $\mu$m, the protection effect thereof is liable to become insufficient. Above 5 $\mu$m, the protective layer is liable to have a lowered surface potential. The protective layer may preferably contain various resins and, if desired, may further contain electroconductive particles composed of metal, metal oxide, etc.

The electrophotographic photosensitive member used in the present invention may be prepared by forming at least a photosensitive layer on an electroconductive support.

The electroconductive support may be composed of a material which per se has an electroconductivity, e.g., a metal, such as aluminum, aluminum alloy, copper, zinc, stainless steel, chromium, titanium, nickel, magnesium, indium, gold, platinum, silver, or iron. Alternatively, the electroconductive support may comprise a plastic material coated, e.g., with a vapor-deposited film of aluminum, indium oxide, tin oxide or gold, or a coating layer of electroconductive particles together with an appropriate binder on a support of a metal or plastic; or a plastic material or paper in mixture with electroconductive particles. The electroconductive support may be formed in a shape of, e.g., a cylinder endless belt or sheet.

The above electroconductive support may preferably have a uniform electroconductivity and a high surface smoothness. Such a high surface smoothness (i.e., small surface roughness) may be required because the surface smoothness of the electroconductive support can affect uniformity and insulating properties of the upper layers to be formed thereon including an undercoating layer, charge generation layer and charge transport layer. Particularly, in the present invention, a thinner photosensitive layer is used, so that the electroconductive support may preferably have a surface roughness of at most 0.2 $\mu$m. If the electroconductive support has a surface roughness of above 0.2 $\mu$m, unevenness caused thereby largely changes characteristics of thinner layers, such as undercoating layer and charge generation layer, thus being liable to develop defects, such as irregularity (or unevenness) in charge injection property or residual potential. The electroconductive support may more preferably have a surface roughness of at most 0.1 $\mu$m. If the electrophotographic photosensitive member has an electroconductive support having a smooth surface, however, interference fringes are liable to be generated on a resultant image more frequently.

In the present invention, the surface roughness may be determined based on a standard deviation a with respect to an average value of measured value (of unevenness) when a region of about 500–2500 $\mu m^2$ is scanned with an interatomic force microscope. For accurate measurement, the scanning is repeated with respect to several regions to provide an average value of standard deviation a, thus determining a surface roughness value of the electroconductive support.

In this instance, a maximum value of unevenness may preferably be at most 3$\sigma$. If an unevenness providing 3$\sigma$ is present, a local charge injection is liable to be caused to occur due to a local electric field, thus resulting in image defects, such as black spots.

The electroconductive support used in the present invention may be constituted by disposing an electroconductive layer on a support. In this instance, the electroconductive layer may readily be formed on the support by applying a dispersion wherein electroconductive particles are dispersed in a binder polymer onto the support. The electroconductive particles may preferably have a primary particle size of at most 0.1 $\mu$m, particularly 0.05 $\mu$m, in order to provide a uniform surface. Examples of the electroconductive particles may include those of electroconductive zinc, electroconductive titanium oxide, aluminum, gold, copper, silver, cobalt, nickel, iron, electroconductive carbon black, ITO (indium-tin oxide), electroconductive tin oxide, indium oxide, and indium. Alternatively, particles of insulating materials surface-coated with a layer of the above electroconductive materials may be used. The electroconductive layer may preferably have a volume resistivity of at most $1\times10^1$ ohm.cm, particularly $1\times10^8$ ohm.cm.

In the photosensitive member used in the present invention, it is also possible to dispose an undercoating layer having an injection barrier function and an adhesive function between the electroconductive support and the photosensitive layer. Such an undercoating layer may be formed of, e.g., casein, polyvinyl alcohol, nitrocellulose, ethylene-acrylic acid copolymer, polyvinyl butyral, phenolic resin, polyamide, polyurethane or gelatin. The undercoating layer may preferably have a thickness of 0.1–10 $\mu$m, particularly 0.3–3 $\mu$m.

FIG. 1 shows a schematic sectional view of a preferred embodiment of the electrophotographic photosensitive member according to the present invention.

Referring to FIG. 1, the electrophotographic photosensitive layer is constituted by disposing an electroconductive support 1 composed of a support 1*a* and an electroconductive layer 1*b*, an undercoating layer 2, and a photosensitive layer composed of a charge generation layer 3 and a charge transport layer 4 containing particles 5 in this order. The charge generation layer 3 may be disposed on the charge transport layer 4.

The image forming apparatus according to the present may include an electroconductive support, an electrophotographic photosensitive member, a charging means, an exposure means, a developing means, a transfer means and a cleaning means.

In the image forming apparatus of the present invention, the above-mentioned various means (e.g., charging means, developing means, transfer means and cleaning means) may be those known in the art. The charging means may preferably be a corona charging means charging the photosensitive member by utilizing corona generated by applying a high voltage to a wire or a contact charging means charging the photosensitive member by applying a voltage to a member, such as a roller, blade or brush, disposed so as to contact the surface of the photosensitive member. In order to attain a high development effect, the developing means may preferably adopt a dry development scheme, particularly a dry and non-contact development scheme susceptible to a potential contrast between the photosensitive member and a developing sleeve.

In the present invention, a toner used in the development step may preferably have a weight-average particle size of 2–10 $\mu$m.

Figure 3:
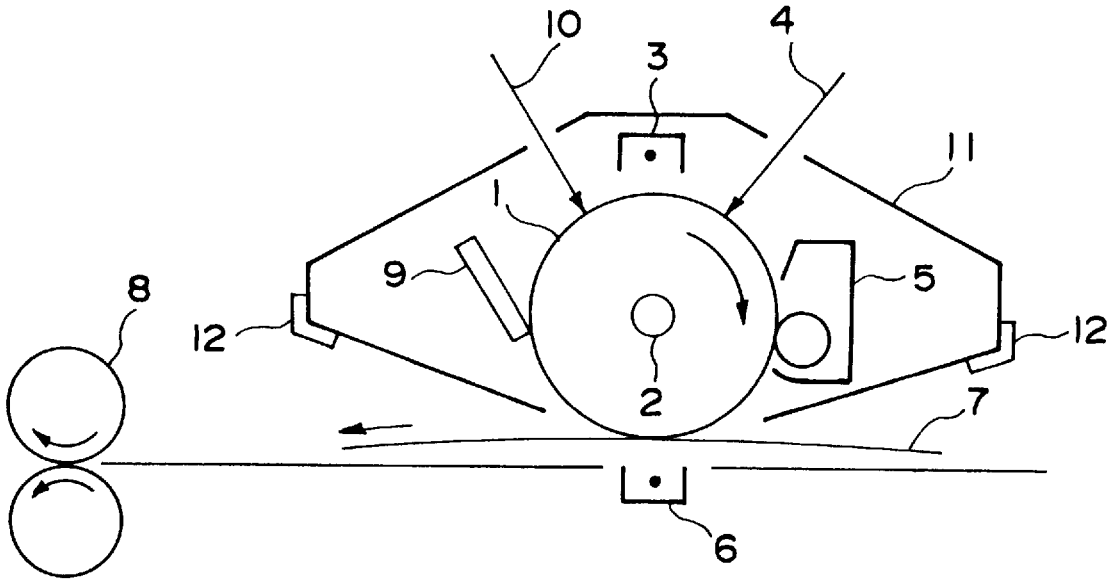
FIG. 3 is a schematic illustration of an embodiment of the image forming apparatus according to the present invention.

FIG. 3 is a schematic sectional view of a first embodiment of an image forming apparatus including a process cartridge according to the present invention.

Referring to FIG. 3, a photosensitive drum (i.e., electrophotographic photosensitive member) 1 is rotated about an axis 2 at a prescribed peripheral speed in the direction of the arrow shown inside of the photosensitive member 1. The surface of the photosensitive member 1 is uniformly charged by means of a primary charging means 3 while being rotated to have a prescribed positive or negative potential. The photosensitive member 1 is exposed to light-image 4 (an exposure light beam) as by laser beam-scanning exposure by using an imagewise exposure means (not shown), whereby an electrostatic latent image corresponding to an exposure image is successively formed on the surface of the photosensitive member 1. The thus formed electrostatic latent image is developed by a developing means 5 to form a toner image on the photosensitive member surface. The toner image is successively transferred to a transfer-receiving material 7 which is supplied from a paper-supply part (not shown) to a position between the photosensitive member 1 and a transfer means 6 in synchronism with the rotating speed of the photosensitive member 1, by means of the transfer means 6.

The transfer-receiving material 7 with the toner image thereon is separated from the photosensitive member surface to be conveyed to an image-fixing device 8, followed by image fixing to be printed out as a copy out of the image forming apparatus. Residual toner particles on the surface of the photosensitive member 1 after the transfer are removed by means of a cleaning means 9 to provide a cleaned surface, and residual charge on the surface of the photosensitive member 1 is erased by a pre-exposure light 10 emitted from a pre-exposure means (not shown) to prepare for the next cycle. In case where a contact charging means using, e.g., a charging roller is used as a primary charging means, the pre-exposure step may be omitted.

In the present invention, a plurality among the above-mentioned structural elements inclusive of the photosensitive member 1, the primary charging means 3, the developing means 5 and the cleaning means 9 can be integrally supported to form a single unit as a process cartridge 11 which is detachably mountable to a main body of an image forming apparatus, such as a copying machine or a laser beam printer, by using a guide means such as a rail 12 in the body.

For example, at least one of the primary charging means 3, developing means 5 and cleaning means 9 may be integrally supported together with the photosensitive member 1 to form a process cartridge 11.

Figure 4:
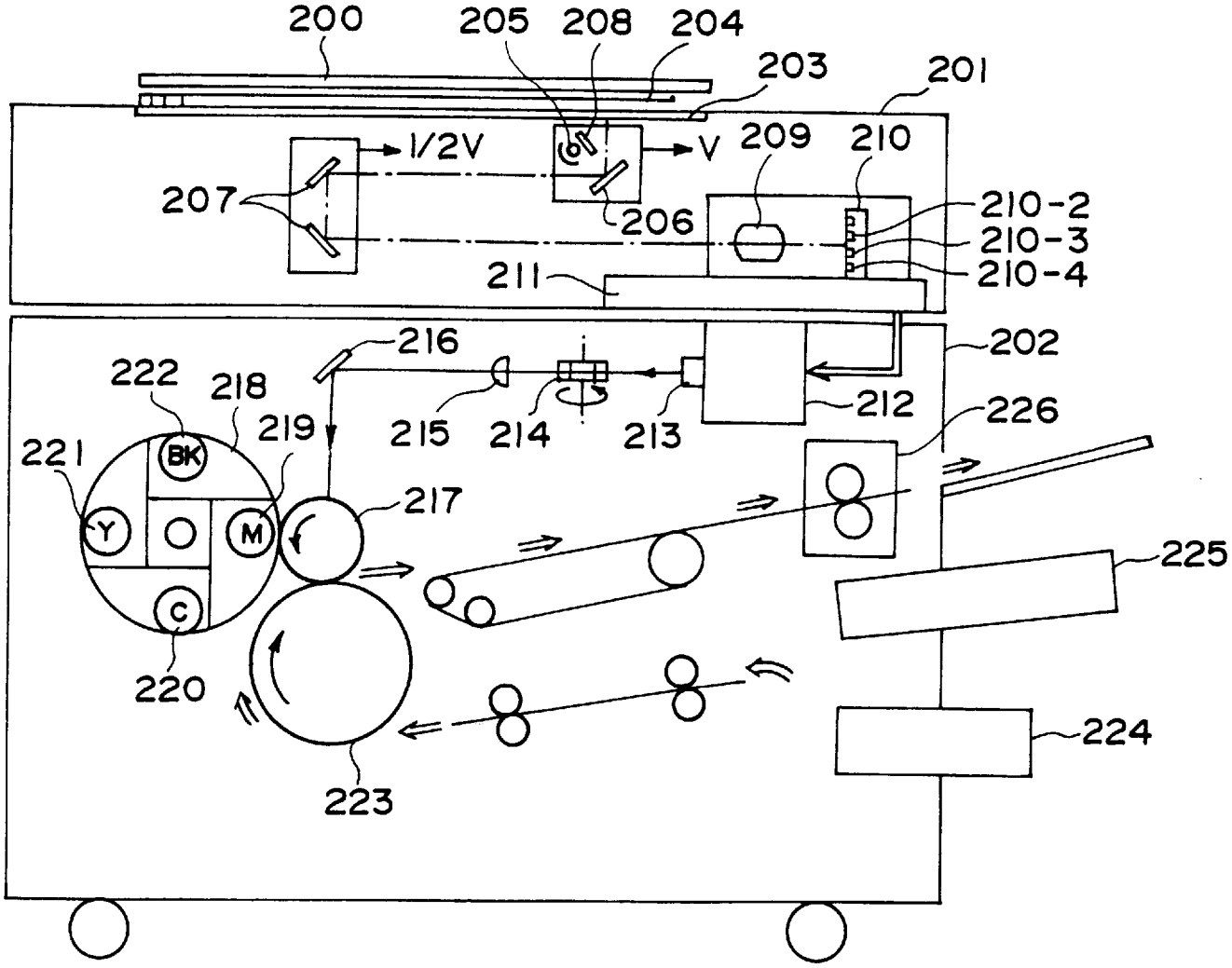
FIG. 4 is a schematic illustration of another embodiment of the image forming apparatus according to the present invention.

FIG. 4 is a schematic sectional view of a color copying machine as a second embodiment of the image forming apparatus according to the present invention.

Referring to FIG. 4, the color copying machine include an image scanning unit 201 for performing operations wherein image data on an original are read out and subjected to digital signal processing, and a printer unit 202 wherein a full-color image corresponding to the original image read out by the image scanning unit 201 is printed out onto a sheet.

More specifically, in the image scanning unit 201, an original 204 disposed on an original glass plate 203 and covered with an original cover 200 is illuminated with a light issued from a halogen lamp 205 via an infrared-cutting (or screening) filter 208. A reflected light from the original is successively reflected by mirrors 206 and 207 and passes through a lens 209 to be imaged in a 3-line sensor (CCD sensor), and then is sent to a signal processing unit 211 as full-color data components of red (R), green (G) and blue (B). The halogen lamp 205 and the mirror 206 are mechanically moved at a velocity (V) and the mirrors 207 are mechanically moved at a velocity (1/2 V) each in a direction (sub-scanning direction) perpendicular to an electrically scanning direction (primary scanning direction) of the line sensor 210 (composed of 210-2, 210-3 and 210-4), thus performing scanning over the entire original.

At the signal processing unit 211, readout signals are electrically processed to be resolved into respective components composed of magenta (M), cyan (C), yellow (Y) and black (B) and are sent to the printer unit 202. Among the above components M, C, Y and B, one component is sent to the printer unit 202 for one scanning operation of the original at the image scanning unit 201. Accordingly, one printout operation (one cycle of color image formation) is performed by four scanning operations in total.

At the printer unit, the image signals for M, C, Y and BK sent from the image scanning unit 201 are sent to a laser driver 212. In accordance with the image signals, the laser driver 212 modulation-drives (modulation-activates) a semiconductor laser 213. The surface of a photosensitive member 217 is scanned with a laser beam (or laser light) via a polygonal mirror 214, a f-θ lens 215 and a mirror 216, whereby electrostatic latent images are successively formed on the photosensitive member 217 corresponding to the original image.

The thus formed electrostatic latent images (for M, C, Y and BK) are developed with corresponding toners, respectively by a rotary developing device 218 composed of a magenta developing unit 219, a cyan developing unit 220, a yellow developing unit 221 and a black developing unit 222 each successively contacting the photosensitive member 217 to form toner images of M, C, Y and BK.

The thus developed toner images formed on the photosensitive member are successively transferred onto a sheet (e.g., a PPC paper as a transfer-receiving material) supplied from a cassette 224 or a cassette 225 by using a transfer drum 223 about which the sheet is wound.

After the transfer step wherein four color images of M, C, Y and BK are successively transferred onto the sheet, the sheet passes through a fixation unit 226 to be conveyed out of the image forming apparatus body.

[EXAMPLES]

Hereinbelow, the image forming apparatus will be described based on examples, wherein "part(s)" are used to mean "part(s)" by weight".

Example 1

An aluminum cylinder (outer diameter=80 mm) having a mirror-finished surface having a surface roughness of at most 0.1 μm as measured by a scanning-type probe microscope ("SPA 300", manufactured by Seiko Denshi Kogyo K. K.) (hereinbelow, a surface roughness was measured by using this apparatus) was prepared.

Onto the aluminum cylinder, a solution of 5 parts of alcohol-soluble nylon copolymer (trade name: "Amilan CM-8000", mfd. by Toray K. K.) in 95 parts of methanol was applied by dipping, followed by drying for 10 minutes at 80° C. to form a 1 μm-thick undercoating layer.

Separately, 5 parts of a bisazo pigment of the formula shown below was added to a solution of 2 parts of polyvinyl benzal (benzal degree=at least 75%) in 95 parts of cyclohexanone and dispersed in a sand mill for 20 hours.

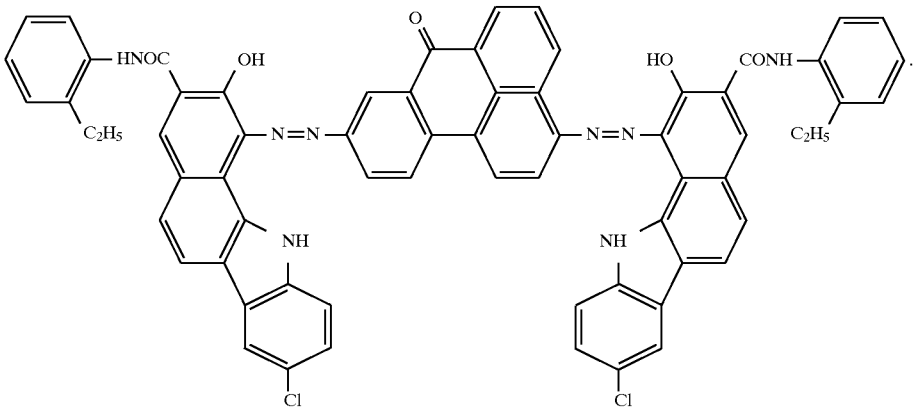

The thus prepared dispersion was applied onto the undercoating layer by dipping, followed by-drying to form a 0.2 μm-thick charge generation layer.

Then, 5 parts of a triarylamine compound of the formula shown below and 5 parts of polycarbonate resin ("Z-200", mfd. by Mitsubishi Gasu Kagaku K. K.) were dissolved in 70 parts of chlorobenzene.

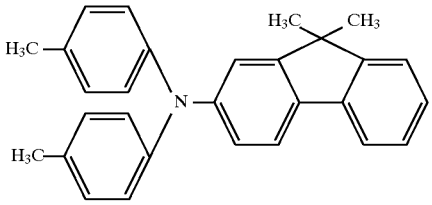

In the solution, 0.3 part of silicone resin particles having a particle size of 2 μm was dispersed at a density of $5\times10^4$ particles/$mm^2$. The dispersion was applied onto the charge generation layer by dipping and dried to form a 10 μm-thick charge transport layer to provide an electrophotographic photosensitive member.

Incidentally, the silicon resin particles showed a refractive index of 1.4. On the other hand, a charge transport layer composed of the triarylamine compound and polycarbonate resin described above, i.e., containing no silicone resin particles described above, showed a refractive index of 1.59. As a result, a difference between the refractive indices of the silicone resin particles and the charge transport layer (i.e., refractive index difference) was 0.19.

The electrophotographic photosensitive member was installed in a remodeled machine of a full-color digital copying machine ("CLC-500", mfd. by Canon K. K.) and evaluated at a dark potential of -400 volts with respect to image forming performance. In this copying machine, a semiconductor laser of 680 nm (wavelength) and 35 mW (output) issuing a laser beam providing a spot area of $2\times10^3$ $m^2$ was used.

As a result of evaluation, a resultant image had no image defects, such as black spots and interference fringes. The resultant image also showed a good gradation reproducibility including 256 gradation levels at 400 dpi. The above evaluation of the resultant image was performed by visual (eye) observation.

Comparative Example 1

An electrophotographic photosensitive member was prepared and evaluated in the same manner as in Example 1 except that the silicone resin particles were not used.

As a result, a lot of interference fringes were observed at an interval (space) of 2–3 mm.

Example 2

An aluminum cylinder (outerdiameter=30 mm) obtained through drawing processing was prepared.

Onto the aluminum cylinder, a dispersion of 200 parts of electroconductive barium sulfate ultrafine particles (primary particle size=0.0 μm) in a solution of 167 parts of phenolic resin (trade name: "Plyophen", mfd. by Dainippon Inki Kagaku Kogyo K. K.) in 100 parts of 2-methoxyethanol (methyl cellosolve) was applied by dipping, followed by drying to form a 10 μm-thick electroconductive layer. The electroconductive layer had a surface roughness of at most 0.1 μm.

An undercoating layer and a charge generation layer were successively formed on the electroconductive layer in the same manner as in Example 1 to have thicknesses identical to those of the layers used in Example 1, respectively.

Then, a 10 μm-thick charge transport layer was formed on the charge generation layer in the same manner as in Example 1 except that 0.5 part of $SiO_2$ particles having a particles size of 1.5 $\mu$m and a refractive index of 1.4 were used instead of the silicone resin particles used in Example 1 and were dispersed at a density of $2\times10^5$ particles/mm$^2$ to prepare an electrophotographic photosensitive member.

The electrophotographic photosensitive member was installed in a remodeled machine of a laser beam printer ("Laser Jet IV", mfd. by Hewlett-Packard Co.) and evaluated at a dark potential of −500 volts with respect to image forming performance. In this printer, a semiconductor laser of 680 nm (wavelength) and 35 mW (output) issuing a laser beam providing a spot area of $1.9\times10^3$ m$^2$ was used.

As a result of evaluation, a resultant image had no image defects, such as black spots and interference fringes. The resultant image also showed a good gradation reproducibility of one pixel in the case of using input signals corresponding to 600 dpi. The above evaluation of the resultant image was performed by visual (eye) observation and by using a 20× magnifier.

Comparative Example 2

An electrophotographic photosensitive member was prepared and evaluated in the same manner as in Example 2 except that $SiO_2$ particles having a particle size of 4 $\mu$m were dispersed at a density of $1.5\times10^4$ particles/mm$^2$.

As a result, some black spots were observed. Further, reproducibility of one pixel was insufficient, thus resulting in irregularity in image.

Example 3

An electrophotographic photosensitive member was prepared and evaluated in the same manner as in Example 2 except that a 12 $\mu$m-thick charge transport layer was formed by dispersing therein $SiO_2$ particles having a particle size of 3 $\mu$m at a density of $4\times10^4$ particles/mm$^2$ As a result, similarly as in Example 2, a resultant image was free from image defects (black spots and interference fringes) and excellent in one pixel-reproducibility at the time of inputting signals corresponding to 600 dpi.

Example 4

An electrophotographic photosensitive member was prepared and evaluated in the same manner as in Example 2 except that a 10 $\mu$m-thick charge transport layer was formed by dispersing therein 0.4 part of silicone resin particles (identical to those used in Example 1) having a particle size of 2 $\mu$m at a density of $1\times10^5$ particles/mm$^2$.

As a result, similarly as in Example 2, a resultant image was free from image defects (black spots and interference fringes) and excellent in one pixel-reproducibility at the time of inputting signals corresponding to 600 dpi.

Example 5

An electrophotographic photosensitive member was prepared and evaluated in the same manner as in Example 1 except that a 8 $\mu$m-thick charge transport layer was formed by using 90 parts of chlorobenzene and dispersing therein 0.1 part of silicone resin particles at a density of $1\times10^4$ particles/mm$^2$.

As a result, similarly as in Example 1, a resultant image was free from image defects (black spots and interference fringes) and excellent gradation reproducibility including 256 gradation levels at 400 dpi.

Comparative Example 3

An electrophotographic photosensitive member was prepared and evaluated in the same manner as in Example 1 except that a 15 $\mu$m-thick charge transport layer was formed by using 50 parts of chlorobenzene and dispersing therein 0.1 part of silicone resin particles at a density of $2\times10^4$ particles/mm$^2$.

As a result, image defects, such as black spots and interference fringes, were not observed but a gradation reproducibility was insufficient.

Comparative Example 4

An electrophotographic photosensitive member was prepared and evaluated in the same manner as in Example 1 except that a 10 $\mu$m-thick charge transport layer was formed by using 75 parts of chlorobenzene and dispersing therein 0.2 part of crosslinked polystyrene resin particles at a density of $2\times10^4$ particles/mm$^2$.

The crosslinked polystyrene resin particles had a refractive index of 1.55, thus providing a refractive index difference (with that (1.59) of charge transport layer) of 0.04.

As a result, black spots were substantially prevented but interference fringes were clearly observed.

Comparative Example 5

An electrophotographic photosensitive member was prepared and evaluated in the same manner as in Example 1 except that a 12 $\mu$m-thick charge transport layer was formed by using 75 parts of chlorobenzene and dispersing therein 1 part of silicone resin particles at a density of $3\times10^5$ particles/mm$^2$.

As a result, image defects, such as black spots and interference fringes, were not observed. However, by high residual voltage of −200 volts was provided and a gradation reproducibility was insufficient.

What is claimed is:

1. A process for forming an electrostatic latent image comprising:

(a) providing an electrophotographic photosensitive member comprising an electroconductive support having a surface roughness of at most 0.2 $\mu$m and a photosensitive layer, disposed on the electroconductive support, comprising a charge generation layer and a charge transport layer, wherein said charge transport layer has a thickness of at most 12 $\mu$m and contains particles having a particle size of 1–3 $\mu$m at a density of $1\times10^4$–$2\times10^5$ particles/mm$^2$, and said charge transport layer has a first refractive index and said particles have a second refractive index, the first and second refractive indices providing a difference therebetween of at least 0.10; and (b) illuminating the photosensitive layer with an exposure light beam providing a spot area "S", wherein said photosensitive layer has a thickness "T", and wherein S and T provide S×T of at most $2\times10^4$ $\mu$m$^3$.

2. A process according to claim 1, wherein said S×T is at least $2\times10^3$ $\mu$m$^3$.

3. A process according to claim 1 or 2, wherein said photosensitive layer has a thickness (T) of at most 10 $\mu$m.

4. A process according to claim 3, wherein said photosensitive layer has a thickness (T) of at most 8 $\mu$m.

5. A process according to claim 1, wherein said exposure light beam is a coherent light beam.

6. A process according to claim 5, wherein said exposure light beam is a laser beam.

7. A process according to claim 1, wherein said photosensitive layer has a thickness of at least 1 $\mu$m.

8. A process according to claim 7, wherein said photosensitive layer has a thickness of at least 3 $\mu$m.

9. A process according to claim 1, wherein said first and second refractive indices provide a difference therebetween of at most 1.00.

10. An image forming apparatus, comprising: an electrophotographic photosensitive member including an electroconductive support having a surface roughness of at most 0.2 $\mu$m and a photosensitive layer disposed on the electroconductive support comprising a charge generation layer and a charge transport layer, charging means for charging the photosensitive member, exposure means for illuminating the charged photosensitive member with light, developing means and transfer means; wherein said charge transport layer has a thickness of at most 12 $\mu$m and contains particles having a particle size of 1–3 $\mu$m at a density of $1\times10^4$–$2\times10^5$ particles/mm$^2$, said charge transport layer has a first refractive index and said particles have a second refractive index, the first and second refractive indices providing a difference therebetween of at least 0.10, and said exposure means providing a spot area "S" and said photosensitive layer has a thickness "T", and wherein S and T provide S×T of at most $2\times10^4$ $\mu$m$^3$.

* * * * *

UNITED STATES PATENT AND TRADEMARK OFFICE

CERTIFICATE OF CORRECTION

PATENT NO. : 5,834,145

DATED : November 10, 1998

INVENTOR(S) : KAZUO YOSHINAGA ET AL.

It is certified that error appears in the above-identified patent and that said Letters Patent is hereby corrected as shown below:

On the title page: Item:

[56] REFERENCES CITED IN U.S. PATENT DOCUMENTS

"4,618,522" should read --4,618,552--.

[57] ABSTRACT

Line 8, "provides" should read --provide--.

COLUMN 1

Line 63, "even an" should read --an even--.

COLUMN 5

Line 11, "include;" should read --include:--.

COLUMN 7

Line 36, "include;" should read --include:--.

COLUMN 8

Line 22, "deviation a" should read --deviation $\sigma$--.
Line 27, "a," should read --$\sigma$,--.
Line 52, "$1x10^1$" should read --$1x10^{10}$--.

COLUMN 9

Line 6, "present" should read --present invention--.

UNITED STATES PATENT AND TRADEMARK OFFICE

CERTIFICATE OF CORRECTION

PATENT NO. : 5,834,145

DATED : November 10, 1998

INVENTOR(S) : KAZUO YOSHINAGA ET AL.

It is certified that error appears in the above-identified patent and that said Letters Patent is hereby corrected as shown below:

COLUMN 10

Line 14, "include" should read --includes--.

COLUMN 11

Line 9, ""part(s)"" should read --"part(s)--.
Line 48, "by-drying" should read --by drying--.

COLUMN 12

Line 17, "$m^2$" should read --$\mu m^2$--.
Line 55, "size=0.0" should read --size=0.05--.

COLUMN 13

Line 2, "particles" should read --particle--.
Line 12, "$m^2$" should read --$\mu m^2$--.

Signed and Sealed this

Fourteenth Day of September, 1999

*Attest:*

Q. TODD DICKINSON

*Attesting Officer*

*Acting Commissioner of Patents and Trademarks*